US005702003A

United States Patent [19]

Springer

[11] Patent Number: 5,702,003

[45] Date of Patent: Dec. 30, 1997

[54] BATH TOY STORAGE UNIT

[76] Inventor: Bonnie L. Springer, 513 Harrison Ave., New York, N.Y. 12839

[21] Appl. No.: 540,085

[22] Filed: Oct. 6, 1995

[51] Int. Cl.[6] ..... B65D 25/04

[52] U.S. Cl. ..... 206/457; D9/310; 220/572; 446/73; 446/74

[58] Field of Search ..... D6/524, 525; D9/310; 4/559, 628, 638, 654, 656, 657, 661; 206/77.1, 457; 220/571–573; 280/47.34, 47.35; 312/228, 228.1, 229; 446/72–74, 97, 99

[56] References Cited

U.S. PATENT DOCUMENTS

| | | | |
|---|---|---|---|
| D. 224,030 | 6/1972 | Eden . | |
| D. 254,439 | 3/1980 | Nottingham et al. . | |
| D. 296,853 | 7/1988 | Slater . | |
| D. 299,095 | 12/1988 | Cresens et al. . | |
| D. 321,825 | 11/1991 | Schlesselman | D9/310 |
| 1,641,061 | 8/1927 | Young | 4/656 |
| 2,109,329 | 12/1937 | Nelson et al. | D9/310 X |
| 2,660,313 | 11/1953 | James | 312/229 |
| 3,445,150 | 5/1969 | Zartarian et al. . | |
| 3,507,416 | 4/1970 | Douglas et al. | 206/457 |
| 4,053,954 | 10/1977 | Chapman . | |
| 4,084,867 | 4/1978 | Putt et al. . | |
| 4,085,987 | 4/1978 | Vartdal | 312/229 |
| 4,098,486 | 7/1978 | Hornsby . | |
| 4,103,455 | 8/1978 | Silvey . | |
| 4,206,567 | 6/1980 | Cieslak . | |
| 4,472,843 | 9/1984 | Chermak . | |
| 4,736,847 | 4/1988 | Wang . | |
| 4,781,643 | 11/1988 | Holloway et al. . | |
| 5,279,412 | 1/1994 | Lee | 4/628 |
| 5,386,909 | 2/1995 | Spector | D9/310 X |

*Primary Examiner*—Jimmy G. Foster
*Attorney, Agent, or Firm*—Brumbaugh, Graves, Donohue & Raymond

[57] ABSTRACT

A bath toy storage unit has a storage chamber that stores bath toys for tidy clean-up after a bath. The storage chamber is accessible by removing a lid or by removing an exterior cover, and includes a perforated surface to hold the toys and to allow water to drain into a collection chamber underneath the surface. A removal tray may be provided for ease of dispensing of collected water. The exterior of the bath toy storage unit may be shaped in the form of an animal to provide incentive for children to place their toys in the unit.

10 Claims, 6 Drawing Sheets

FIG. 8
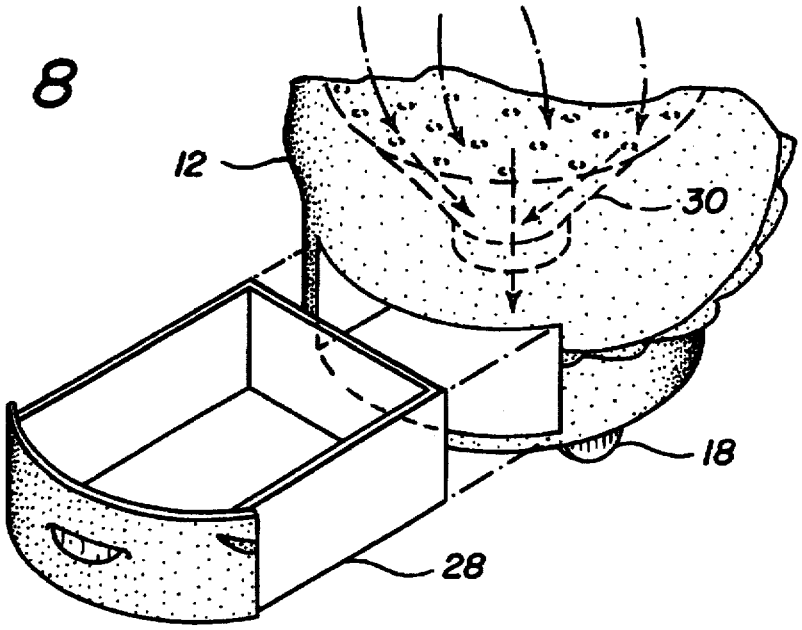
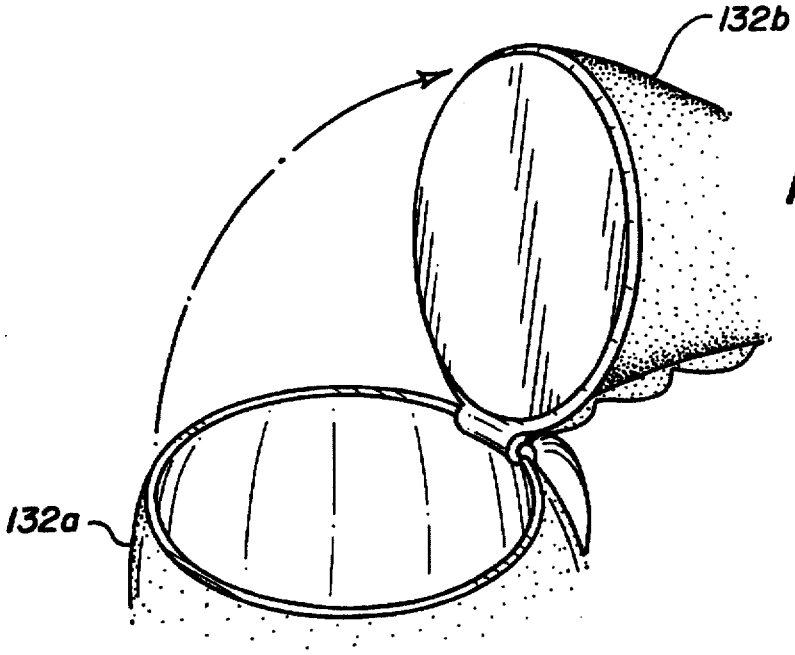
FIG. 9

BATH TOY STORAGE UNIT

BACKGROUND OF THE INVENTION

1. Field of the Invention

The present invention relates to a toy storage unit for storing wet bath toys for tidy clean-up after a bath.

2. Prior Art

The prior art discloses various toy storage units. For example, U.S. Pat. No. 4,103,455 discloses a toy chest in the shape of an animal form that produces visual and audible rewards when a child places a toy in the storage compartment, U.S. Pat. No. 4,736,847 discloses a play bin made with a cover that stretches over a resilient frame simulating an animal form, and U.S. Pat. No. 4,781,643 discloses a toy box in the shape of a tree with a hollow trunk, a removable lid, and side openings. Various design patents also show toy chests in the shape of animal forms. U.S. Des. Pat. No. 224,030 (a bear figure) and U.S. Des. Pat. No. 254,439 (a pig figure) are representative of these patents. In addition, the prior art includes devices that store wet items. For example, U.S. Pat. No. 4,084,867 discloses a storage cabinet for ski equipment, U.S. Pat. No. 3,445,150 discloses a dish cart, U.S. Pat. No. 4,472,843 discloses a bathtub accessory holder, U.S. Pat. No. 4,053,954 discloses a bathtub caddy, and U.S. Pat. No. 4,098,486 discloses a bathroom caddy.

To date, however, no toy storage units have been appropriate for storing bath toys because none have contained a means to collect and dispose of the water that accumulates from the bath toys. Moreover, none of the wet storage devices in the prior art have addressed the need to store bath toys. The present invention provides a simple storage unit for bath toys that has an easily accessible storage chamber, a surface that allows the water from the toys to drain into a collection chamber, and means permitting easy removal of the accumulated water from the collection chamber. The present invention may also be made in the shape of an animal to provide incentive to children to clean-up after themselves.

SUMMARY OF THE INVENTION

In accordance with the invention, a bath toy storage unit includes a hollow base section for storing toys and for collecting, for subsequent dispensing, water draining from the toys. An access opening for storage of toys within the unit is provided at the upper end of the base section. A drainage chamber is formed at the bottom of the base section, and a perforated member overlies the drainage chamber for supporting the toys. An animal-shaped removable cover fits on the base section and covers the toy access opening.

In one embodiment, the animal-shaped cover fits over and surrounds the base section, and access to the interior of the base section for toy storage or retrieval or for dispensing collected water is obtained by removing the entire animal-shaped cover.

In another embodiment, the exterior of the base section itself is animal-shaped and the upper section of the animal shape comprises a cover in the form of a lid for the base section. The lid may be entirely removable from the base section or may be hinged to the base section.

In a further embodiment, a tray accessible from the exterior may be provided in the drainage chamber for collecting and dispensing water.

DESCRIPTION OF THE DRAWINGS

Further objects and advantages of the invention will be apparent from the following description of representative embodiments thereof, taken in conjunction with the accompanying drawings, in which:

FIG. 8 is a partial perspective view of an alternate means of trapping and dispensing water in the embodiments of FIGS. 1 and 5; and FIG. 9 is a partial perspective view of an alternate means of gaining access to the storage chamber of the embodiments of FIGS. 1 and 5.

DESCRIPTION OF THE PREFERRED EMBODIMENTS

Figure 1:
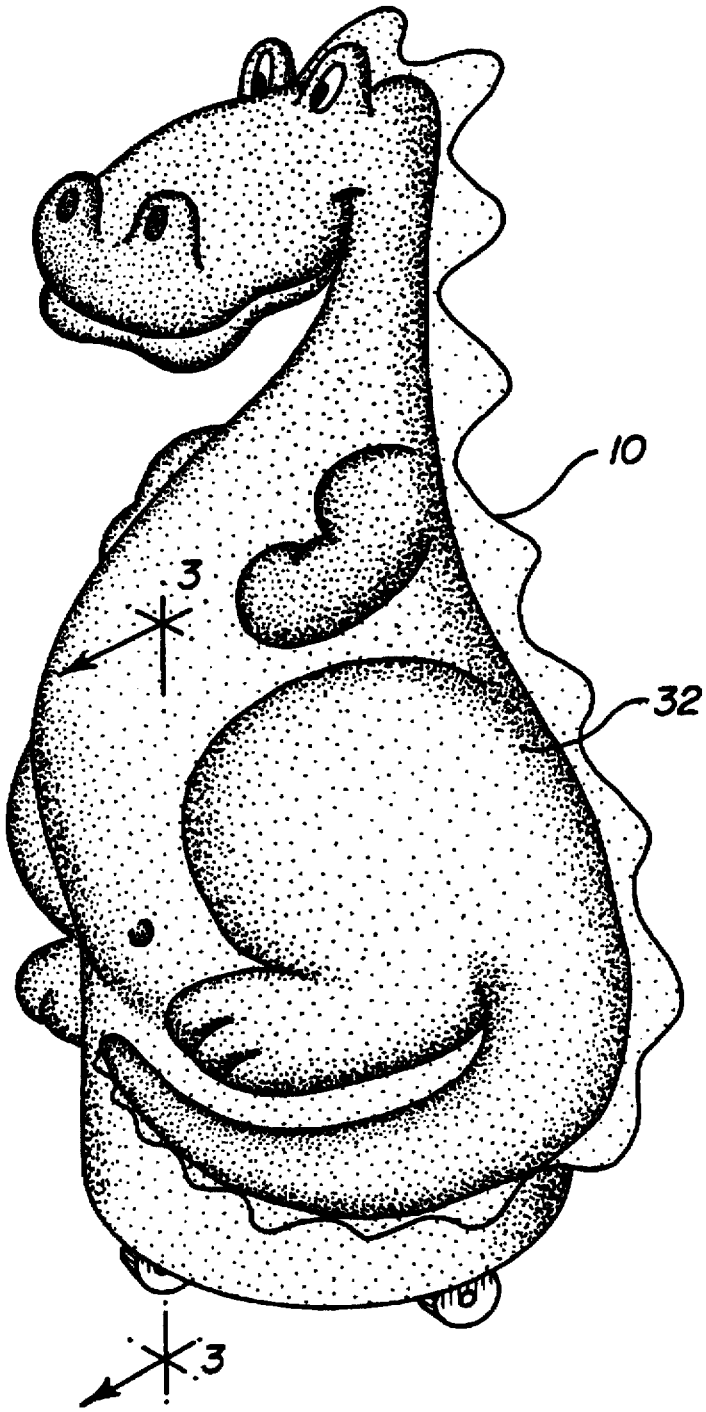
FIG. 1 is a perspective view of the exterior of one embodiment of the invention.
Figure 2:
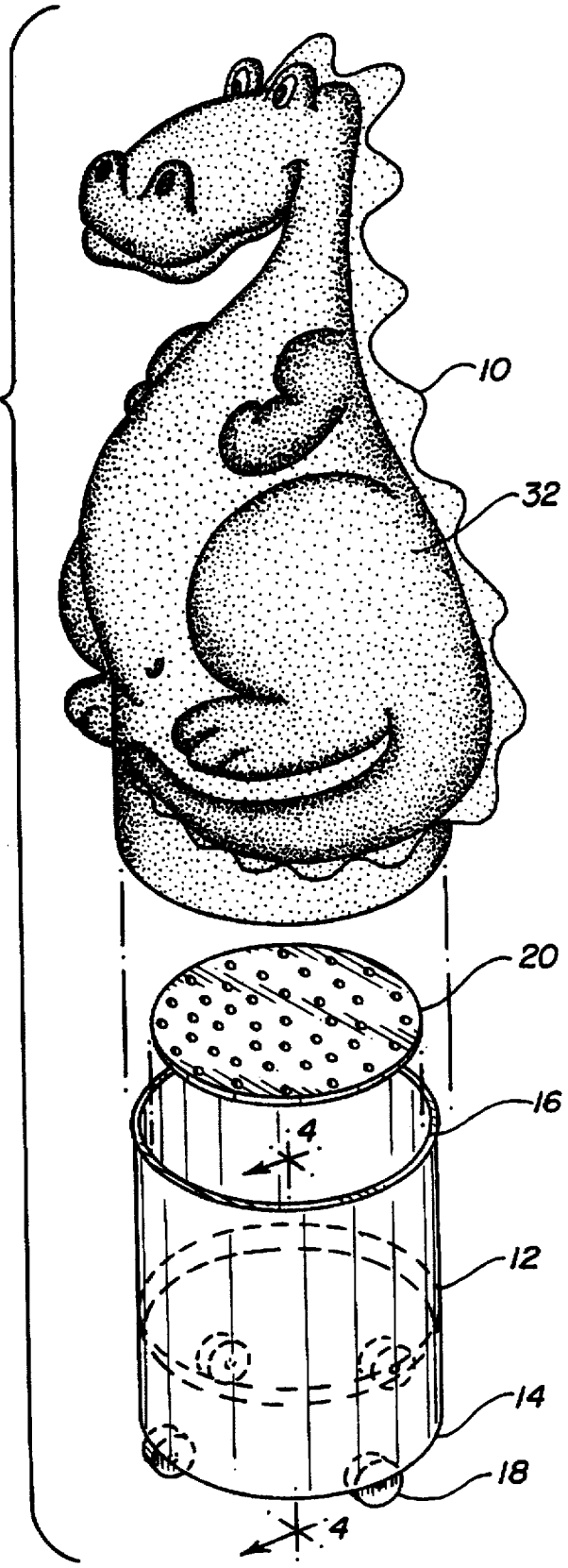
FIG. 2 is an exploded perspective view of the embodiment of FIG. 1, showing details of the interior structure of the storage unit.
Figure 3:
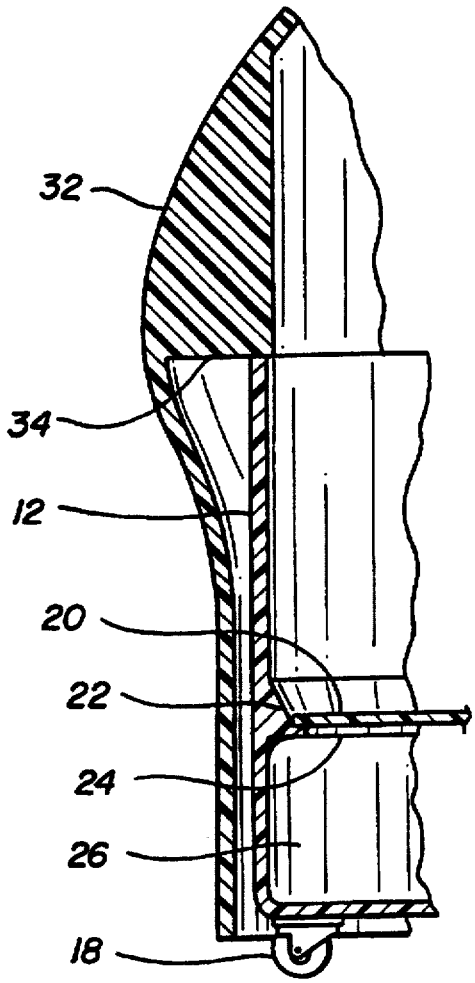
FIG. 3 is a partial vertical cross-sectional view taken along the line 3—3 in FIG. 1 and looking in the direction of the arrows.
Figure 4:
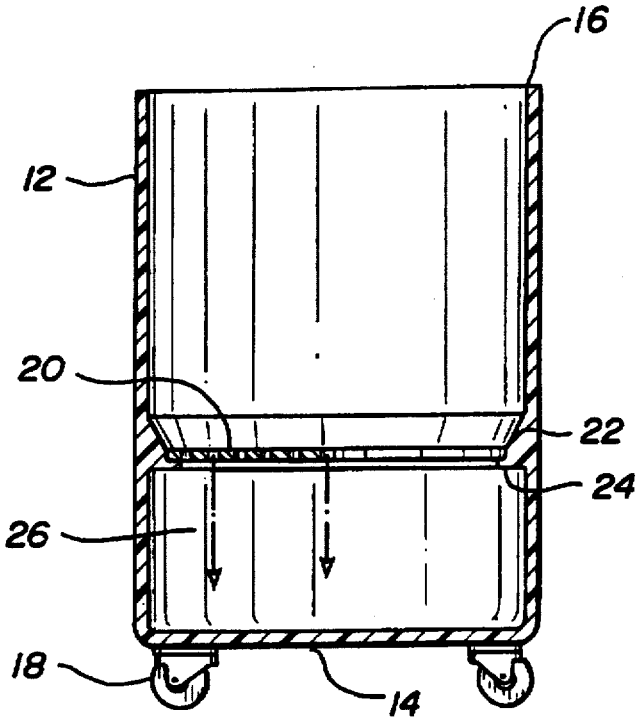
FIG. 4 is a vertical cross-sectional view taken along line 4—4 in FIG. 2 and looking in the direction of the arrows.

As shown in FIGS. 1–4, one embodiment of the bath toy storage unit of the invention indicated generally at 10, includes a hollow cylindrical base section 12 closed at the bottom 14 and open in the upper region 16. The base section 12 preferably has wheels 18 attached to the bottom for ease of mobility of the unit 10. A perforated disc-shaped member 20, having a diameter slightly smaller than the diameter of the inside wall of the base section 12, fits through the upper opening of the base section 12. As best seen in FIGS. 3 and 4, a tapered shoulder 22 on the inside wall of the base section 12 tapers inwardly and terminates in a horizontal flange 24 of a diameter slightly smaller than the diameter of the member 20. When the member 20 is placed inside the base section 12, it rests against and is supported by the flange 22.

In use, the bath toys are placed on the perforated disc-shaped member 20. The water drains through the holes in member 20 and is collected in a drainage chamber 26 formed at the bottom of the base section 12 as shown in FIG. 3 and FIG. 4. The water is then dispensed by removing the bath toys and the member 20 and inverting the base section 3. Alternatively, as shown in FIG. 8, a removable tray 28 may be used to collect and dispense the water. As shown in dashed line in FIG. 8, a funnel-shaped member 30 may be provided below the flange 24 to facilitate collection of the water in the tray 28.

The upper opening of the base section 12 may be closed in several ways. First, FIGS. 1–3 illustrate a hollow animal-shaped cover 32 that fits over the base section 12. As shown in FIG. 3, the inside wall of the cover 32 has a lip 34 that protrudes inwardly to a diameter slightly less than the diameter of the base section 12. Thus when the cover 32 is slipped over the base section 12, the lip 34 contacts the top of the base section 12 and prevents the bottom of the cover 32 from touching the floor. The cover 32 may take any desired animal, or other ornamental, configuration.

Figure 5:
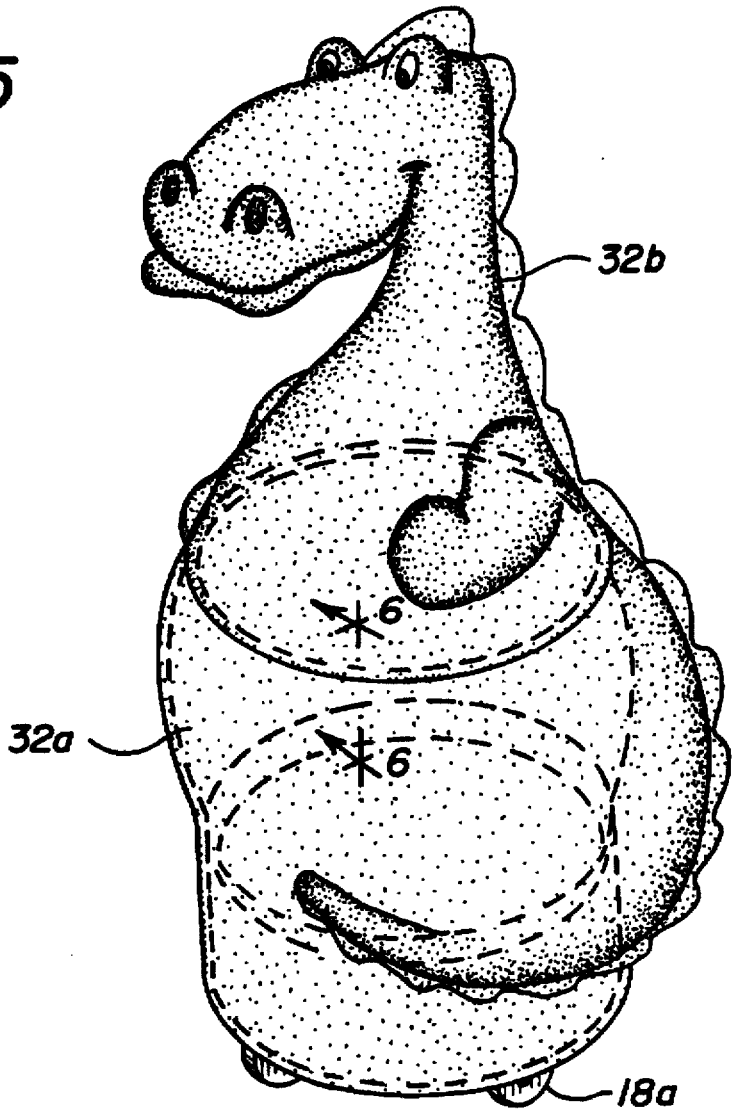
FIG. 5 is a perspective view of the exterior of another embodiment of the invention.
Figure 6:
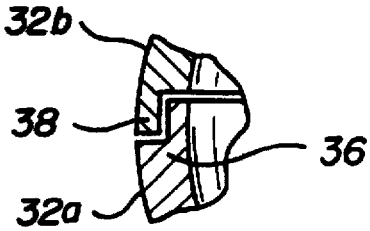
FIG. 6 is a partial vertical cross-sectional view of the embodiment of FIG. 5 taken along line 6—6 of FIG. 5 and looking in the direction of the arrows.
Figure 7:
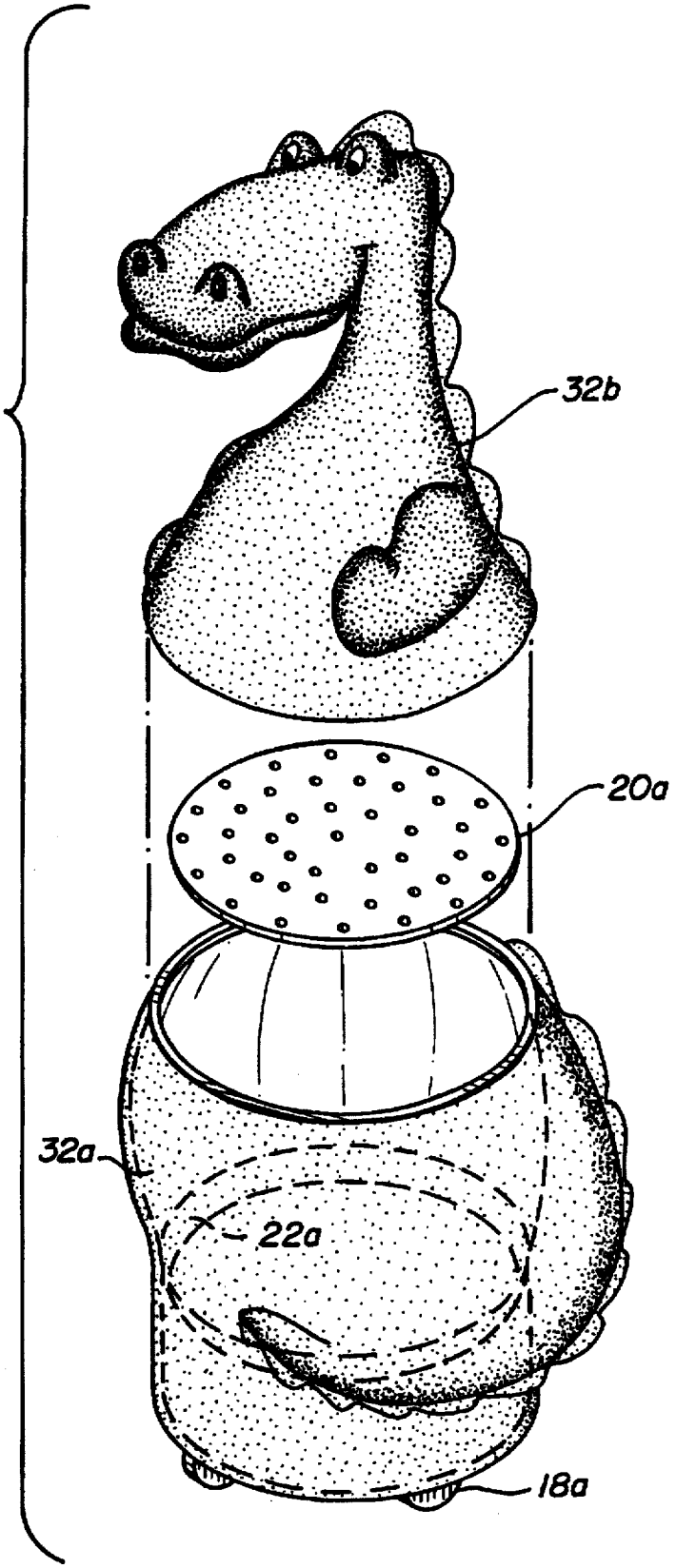
FIG. 7 is an exploded perspective view of the embodiment of FIG. 5.

In the embodiment of FIGS. 5–7, the separate cylindrical base section is eliminated, and the base section 32*a* of the animal-shaped cover may itself be formed to carry the shoulder 22*a* for supporting the disc-shaped member 20*a*. FIGS. 5–7 also illustrate a second way of closing the upper opening of the base section. As shown, the upper section 32*b* of the animal-shaped cover may be removably mounted on the base section 32*a*. To that end, overlapping lips 36 and 38 may be formed, as shown in FIG. 6, on the bottom and upper sections 32*a* and 32*b*, respectively.

FIG. 9 shows a third way of closing the upper opening of the base section 132*a* by the use of a hinged upper section 132*b*.

With the two embodiments of FIGS. 5–7 and 9, the removable upper section 32*b* and the hinged upper section 132*b* may be in the form of an animal head and the exterior of the base section 32*a* and 132*a* may be shaped in the form of an animal body.

Although the invention has been described and illustrated herein by reference to representative embodiments thereof, it will be understood that such embodiments are susceptible of variation and modification without departing from the inventive concepts disclosed. All such variations and modifications, therefore, are intended to be included within the spirit and scope of the appended claims.

I claim:

1. An animal shaped toy storage unit for storing and draining a plurality of wet bath toys, comprising:

a base section;

an upper toy storage chamber in the base section for accommodating a plurality of wet bath toys;

a toy access opening in the base section above the toy storage chamber;

a bath water collecting chamber in the base section below the toy storage chamber for collecting the bath water drained from the toy storage chamber, said bath water collecting chamber having a lesser height than said toy storage chamber;

a perforated bath toy supporting wall in the base section separating the toy storage chamber and the bath water collecting chamber to retain the bath toys in the toy storage chamber while permitting drainage of the bath water through the toy supporting wall; and a cover for the base section, said cover being removable at least in part to permit access to the toy access opening, the top of the cover being shaped in the form of the head of the animal.

2. The bath toy storage unit of claim 1 in which said cover comprises an exterior animal form that fits over and covers the base section.

3. The bath toy storage unit of claim 1 in which a plurality of wheels are attached to the bottom of the base section.

4. The bath toy storage unit of claim 1 in which the exterior of the base section is shaped to simulate an animal form.

5. The bath toy storage unit of claim 4 in which the cover comprises a removable upper section shaped in the form of an animal head.

6. The bath toy storage unit of claim 5 in which the removable upper section is hinged to the base section.

7. The bath toy storage unit of claim 4 further comprising a removable tray extending into said bath water collecting chamber and accessible from the exterior of said base section for removal and dispensing of collected water.

8. The bath toy storage unit of claim 1 further comprising a removable tray extending into said bath water collecting chamber and accessible from the exterior of said base section for removal and dispensing of collected water.

9. An animal shaped toy storage unit for storing and draining a plurality of wet bath toys, comprising:

a base section;

an upper toy storage chamber in the base section for accommodating a plurality of wet bath toys;

a toy access opening in the base section above the toy storage chamber;

a bath water collecting chamber in the base section below the toy storage chamber for collecting the bath water drained from the toy storage chamber;

a perforated bath toy supporting wall in the base section separating the toy storage chamber and the bath water collecting chamber to retain the bath toys in the toy storage chamber while permitting drainage of the bath water through the toy supporting wall; and a cover for the toy access opening, said cover being removably mounted on the base section to permit access to the toy access opening and having a lower portion which telescopes with at least a portion of the base section, the top of the cover being shaped in the form of the head of the animal.

10. The bath toy storage unit of claim 9 in which the base section and the cover have overlapping peripheral lips which telescope with one another when the cover is mounted on the base section.

* * * * *